United States Patent [19]

Funahashi

[11] 4,038,918

[45] Aug. 2, 1977

[54] HAND STAMP

[76] Inventor: Takaji Funahashi, No. 1, 2-chome, Kitatakasho, Nishi, Nagoya, Aichi, Japan

[21] Appl. No.: 619,814

[22] Filed: Oct. 6, 1975

[30] Foreign Application Priority Data

Oct. 15, 1974 Japan ..... 49-124421[U]
Dec. 26, 1974 Japan ..... 50-2360[U]

[51] Int. Cl.[2] ..... B41J 1/60

[52] U.S. Cl. ..... 101/111; 101/327; 101/368

[58] Field of Search ..... 101/333, 327, 103-105, 101/111, 334, 125, 368, 405

[56] References Cited

U.S. PATENT DOCUMENTS

| | | | |
|---|---|---|---|
| 1,067,448 | 7/1913 | Standley | 101/103 |
| 2,598,806 | 6/1952 | Lauer | 101/327 X |
| 2,900,902 | 8/1959 | Becker | 101/327 X |
| 3,099,955 | 8/1963 | Keck | 101/105 |
| 3,421,437 | 1/1969 | Funahashi | 101/327 |

*Primary Examiner*—Edgar S. Burr
*Assistant Examiner*—A. Heinz

[57] ABSTRACT

This hand stamp comprises a frame; an ink absorber, a printing body, said printing body including a letter portion disposed to project slightly from the end of the said frame body, a leg frame arranged and supported on the outside of said frame to surround said frame, said leg frame being mounted so that it can project from or cave in from the position of said letter portion and said leg frame having an opening allowing said letter portion to pass therethrough; and spring means for pushing said leg frame to project said leg frame from the position of said letter.

2 Claims, 15 Drawing Figures

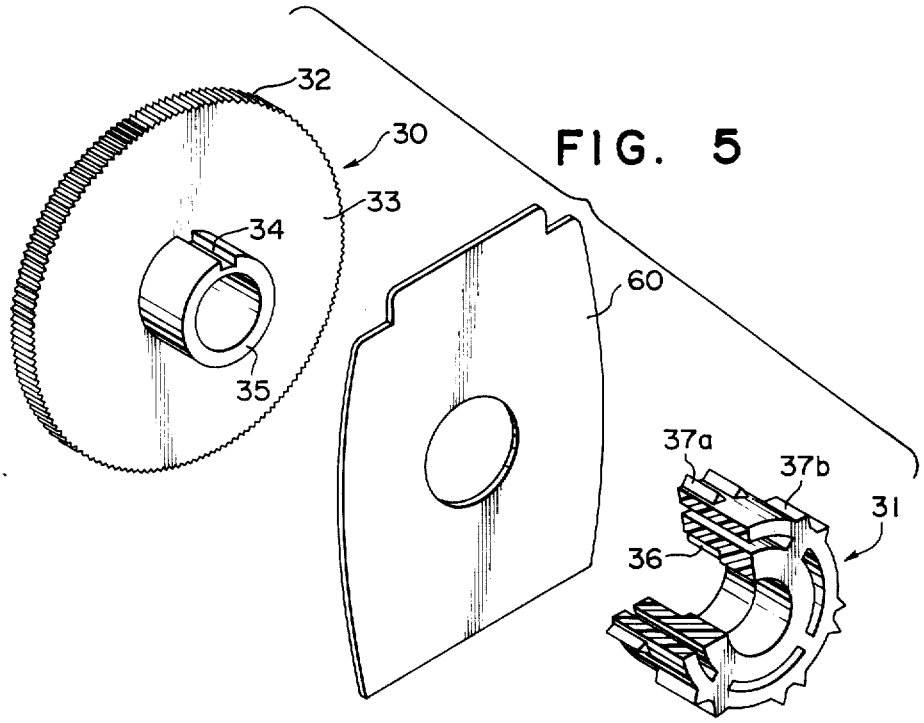
FIG. 5
FIG. 6
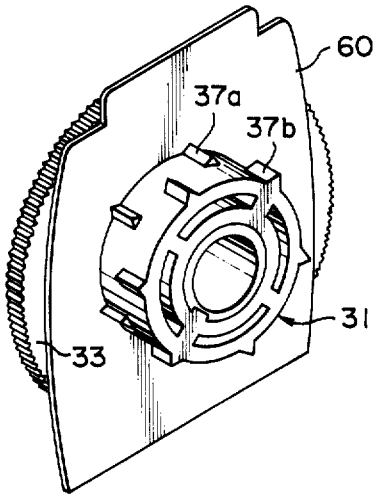
FIG. 7
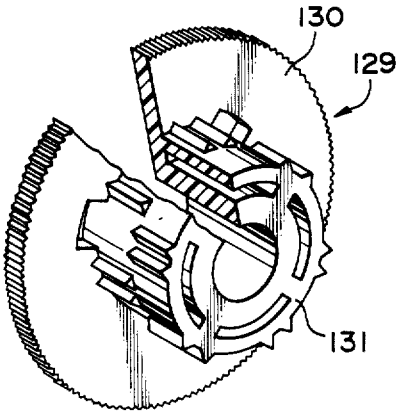

HAND STAMP

BACKGROUND OF THE INVENTION

This invention relates to a hand stamp.

As the conventional hand stamp, there can be mentioned a hand stamp having a flat and fixed printing body and a rotational hand stamp in which a printing body can be rotated. In each of these hand stamps, however, a stamp pad should inevitably be used, and every time stamping is conducted, the hand stamp should be pressed to the stamp pad so that stamp ink is transferred from the stamp pad to the letter surface of the printing body of the hand stamp. Accordingly, when such conventional hand stamp is used, the stamping operation is troublesome and the operation efficiency is very low.

As means for overcoming the foregoing defect involved in the conventional hand stamps which should be used in combination with the stamp pad, I previously proposed various hand stamps comprising a porous rubbery printing body having an infinite number of interconnecting cells and an ink absorber for transferring ink to the printing body and rotational hand stamps comprising an integrated assembly of a porous rubbery printing body having an infinite number of interconnecting cells and a tough endless cloth, and an ink absorber for transferring ink to the assembly from the back surface thereof. These hand stamps are epoch-making hand stamps for which a stamp pad need not be used.

More specifically, a hand stamp of one conventional type proposed by me comprises a frame body, an ink absorber contained in said frame body, a printing body composed of a porous material having an infinite number of interconnecting cells and disposed in contact with said ink absorber, said printing body being provided with a printing letter portion projecting slightly from the end of said frame body, a leg frame disposed and supported inside said frame body so that it can project from or cave in from the position of said printing letter portion, said leg frame having an opening allowing said printing letter portion to pass therethrough, and a spring for pushing the leg frame to project it from the position of said printing letter portion.

In a hand stamp of this type, ink absorbed and stored in the ink absorber is fed to the printing body and ink is always caused to ooze out on the pring letter portion of the printing body. In case stamping is conducted, the top end of the leg frame is pressed to the paper surface and at this point, the leg frame is caused to cave in against the spring, whereby the printing letter portion of the printing body is contacted with the paper surface and stamping is accomplished. While this hand stamp is not used, since the leg frame is allowed to project from the ink-oozing printing letter portion by the elastic force of the spring, even if the hand stamp is placed on a desk or the like, it is not blurred with ink or a finger or hand is not stained with ink.

In a hand stamp of this type, however, since the leg frame is disposed inside the frame body, the size or contour of the end edge of the frame body, is relatively large as compared with the that of the printing letter portion having predetermined size and the contour of the leg frame is smaller than that of the frame body. Accordingly, when the hand stamp is placed on a desk or the like with the leg frame being contacted with the surface of the desk, the stability is very low. Further, at the hand stamp assembly step, since it is necessary to dispose the leg frame in the interior of the frame body prior to installation of the ink absorber and printing body in the frame body, the assembling step is complicated and troublesome.

A hand stamp of another conventional type proposed by me comprises a frame body; a shaft attached to an almost central portion of the frame body and a plurality of rotary members supported rotatably on said shaft, each of said rotary members comprising an annular plate having non-skid teeth on the peripheral edge thereof and a hanging cylinder mounted on one side face of said annular plate, a plurality of ridges having a cone-shaped section being formed on the outer side face of said hanging cylinder, being arranged in the axial direction of said hanging cylinder and being spaced equidistantly in the peripheral direction; a bridge member laid on the lower end of said frame body; and a plurality of printing bodies of an endless belt form hung around the hanging cylinders of respective rotary members and around said bridge member, each of said printing bodies having on the surface thereof an infinite number of printing letter portions.

In the hand stamp of this type, when the annular plates having non-skid teeth are grasped with fingers and respective hanging cylinders are rotated, by virtue of friction between the ridges on each hanging cylinder and printing bodies of an endless belt form engaged with said ridges, said printing bodies can be rotated. In case the distance in the peripherical direction between two adjoining ridges corresponds to the size of each printing body of an endless belt form in the lengthwise direction, namely in case the number of the ridges is relatively small, since the ridges are engaged with the endless printing bodies with a relatively sharp engaging angle, the friction caused between them is relatively large, and hence, the rotation power of the hanging cylinders is transmitted to the endless printing bodies assuredly. However, in this case, a relatively large force is required for rotation of the hanging cylinders.

In case the distance in the peripheral direction between the two adjoining ridges is relatively small, namely in case the number of the ridges is relatively large, since the engaging angle between the ridges and the endless printing bodies is relatively obtuse, the friction caused between them is relatively small, and hence, the transmission of the rotation power of the hanging cylinders to the printing bodies of an endless belt form is not assured.

SUMMARY OF THE INVENTION

It is therefore a primary object of this invention to provide a novel improved hand stamp which can overcome the foregoing defects and disadvantages involved in the conventional hand stamps.

Another object of this invention is to provide a hand stamp which shows a good stability or balance when placed on a desk or the like and which can be constructed and assembled very easily without particular troubles.

Still another object of this invention is to provide a hand stamp in which printing bodies of an endless belt form can be rotated assuredly with a relatively small force.

In accordance with one aspect of this invention, there is provided a hand stamp comprising a frame body; an ink absorber contained in said frame body; a printing body composed of a porous material having an infinite number of interconnecting cells, said printing body being disposed in said frame body so that it is contacted with said ink absorber and said printing body including a printing letter portion disposed to project slightly from the end edge of said frame body; a leg frame arranged and supported on the outside of said frame body to surround said frame body, said leg frame being mounted so that it can project from or cave in from the position of said printing letter portion and said leg frame having an opening allowing said printing letter portion to pass therethrough; and spring means for pushing said leg frame to project said leg frame from the position of said printing letter. In accordance with one preferred embodiment of this invention, there is provided a hand stamp having the above structure which further comprises a shaft attached to an almost central portion of said frame body; a plurality of rotary members rotatably supported on said shaft, each rotary member comprising an annular plate having non-skid teeth on the peripheral edge thereof and a hanging cylinder formed on one side face of said annular plate, a great number of ridges having a cone-shaped section being formed on the outer side face of said hanging cylinder to extend in the axial direction thereof so that they are spaced from one another in the peripheral direction of said hanging cylinder; and a bridge member laid on the lower end of said frame body; wherein said ink absorber is supported in said bridge member and said printing body comprises a plurality of sections of an endless belt form, each section of said printing body being hung around the corresponding hanging cylinder of the rotary member and the lower face of the ink absorber supported in said bridge member.

In accordance with another preferred embodiment of this invention, there is provided a hand stamp having a structure set forth in the above preferred embodiment, wherein the ridges formed on the hanging cylinder of each rotary member are divided into two front and rear groups with respect to the axial direction of the hanging cylinder and both the groups of the ridges are arranged so that the positional phases in the peripheral direction of both the groups of the ridges are different from each other; said frame body has a substantially reverse U-figured shape and comprises a top plate and side plates connected to the edges of the top plate, each side plate having a longitudinally long hole substantially at the center thereof, an opening slightly below said long hole and a notch at the center of the lower edge portion, and one side plate having a recess at the center of said notch; said shaft is attached to said side plates of said frame body at said long holes; said bridge member comprises a bridge girder including a long plate, downwardly bent portions extended from respective ends of the long plate, outwardly bent portions extended from said downwardly bent portions and upwardly bent portions extended from said outwardly bent portions an opening being formed on one of downwardly bent portions, an ink absorber-containing casing including a top face wall, two downwardly extending side walls, two downwardly extending end walls and a downwardly facing opening in the lower portion thereof, a short cylinder for feed-ink being mounted on one of said end walls, and a bottom lid including a long plate having a long open hole and two upwardly extending side walls; said bridge girder is disposed so that respective outwardly bent portions thereof are placed on the notches of the corresponding side plates of said frame body; said casing is disposed between the downwardly bent portions of said bridge girder so that the short cylinder thereof is located through the opening of said bridge girder and the recess of the side plate of said frame body; said ink absorber is disposed in said casing; said bottom lid is disposed so that said casing is covered with the two upwardly extending side walls thereof and the lower face of said ink absorber projects slightly from the long open hole of said bottom lid; each of sections of the printing body having an endless belt form is hung on the hanging cylinder of the corresponding rotary member and around said bottom lid; said leg frame comprises a long plate having a long hole, upwardly extending side walls and upwardly extending end walls having a guiding opening, a lateral flange being disposed on the top end of each of said outwardly extending walls; said spring means comprises a pair of spring members, each spring member including a supporting member having a leg portion and a spring supported on said leg portion; said upwardly extending walls of said leg frame are disposed so that they surround the outsides of the respective side plates of said frame body; said upwardly bent portions of said bridge girder are disposed in the guiding openings of the corresponding end walls of the leg frame; the respective leg portions of said spring means are engaged with the lower openings of the corresponding side plates of said frame body; and lateral flanges on the upwardly extending end walls of said leg frame are disposed so that they are pressed by the corresponding springs of said spring means.

In accordance with another aspect of this invention, there is provided a hand stamp comprising a frame body; a shaft attached to an almost central portion of said frame body; a plurality of rotary members rotatably supported on said shaft, each rotary member comprising an annular plate having non-skid teeth on the peripheral edge thereof and a hanging cylinder disposed on one side face thereof, a great number of ridges having a cone-shaped section being formed on the outer side face of said hanging cylinder to extend in the axial direction of the hanging cylinder so that they are spaced from one another in the peripheral direction of the hanging cylinder, said ridges being divided into two front and rear groups with respect to the axial direction of the hanging cylinder and both the groups of the ridges being arranged so that the positional phases in the peripheral direction of both the groups of the ridges are different from each other; a bridge member laid on the lower end of said frame body; and a printing body comprising a plurality of sections of an endless belt form hung on the hanging cylinders of the corresponding rotary members and around said bridge members, each section of the printing body having on the surface thereof a great number of printing letter portions.

BRIEF DESCRIPTION OF THE DRAWINGS

FIG. 5 is a partially cut-out, fragmentary perspective view of the rotary member and partition plate of FIG. 4;

FIG. 6 is a perspective view showing one modification of the rotary member and partition plate of FIG. 4;

FIG. 7 is a partially cut-out perspective view showing another modification of the rotary member and partition plate of FIG. 4;

Figure 1:
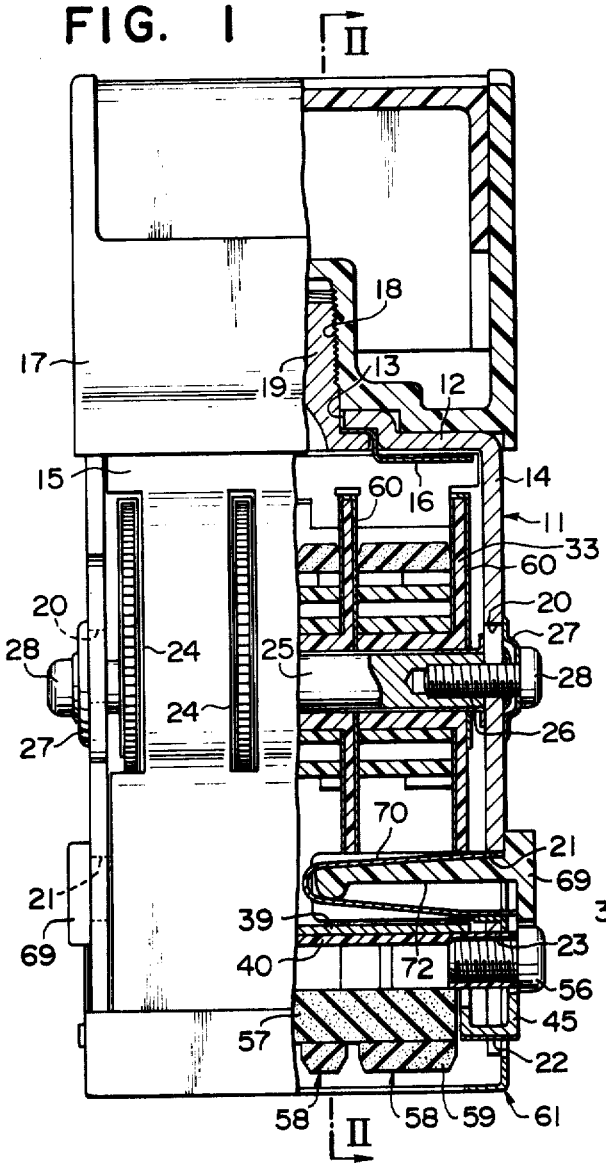
FIG. 1 is a partially longitudinally sectional front view of an embodiment of the hand stamp of this invention.
Figure 2:
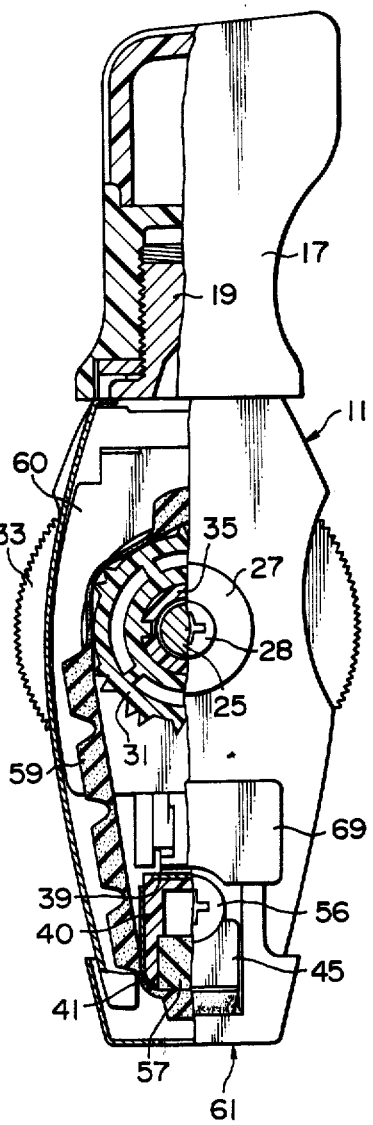
FIG. 2 is a side view of the embodiment of FIG. 1, which illustrates the section taken along the line II—II in FIG. 1.
Figure 3:
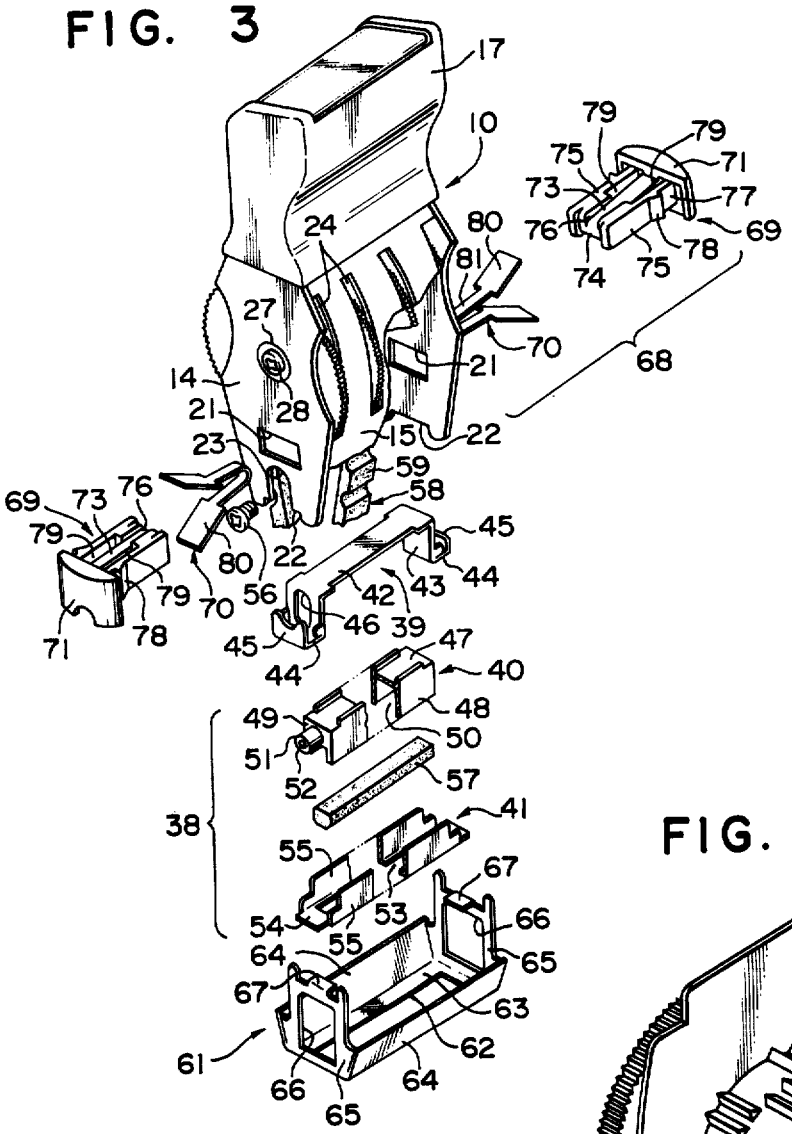
FIG. 3 is a fragmentary perspective view of the embodiment of FIG. 1.
Figure 4:
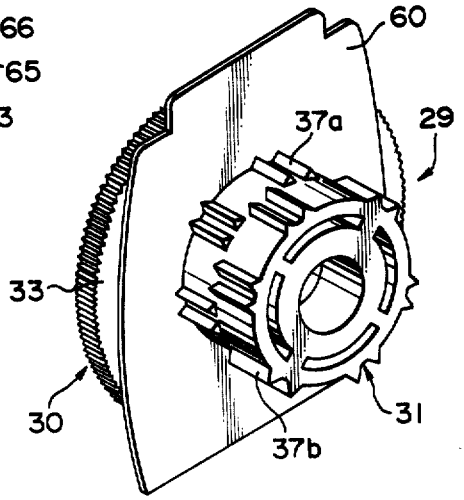
FIG. 4 is a perspective view showing the rotary member and partition plate in the embodiment of FIG. 1.

DETAILED DESCRIPTION OF THE PREFERRED EMBODIMENTS:

This invention will now be described in detail by reference to embodiments shown in the accompanying drawings.

Referring now to FIGS. 1 to 5, a frame body 10 comprises a metal plate member 11 of a substantially reverse U-figured shape including a top plate 12 having a hole 13 at the center thereof and side plates 14 extended from respective ends of the top plate 12, and two metal cover plates 15 having a flange in the upper portion thereof.

A handle 17 has a screw hole 18 in the lower portion thereof, and the top plate 12 of the metal plate member 11 and a flange member 16; are disposed to the lower face of the handle 17. When a screw 19 is passed through the central hole of the flange member 16 and the hole 13 of the top plate 12 and screwed into the screw hole 18 of the handle 17, the frame body 10 is attached to the handle 17. The flanges of the metal cover plates 15 are inserted between the top plate 12 and the flange member 16.

Each side plate 14 of the metal plate member 11 has a longitudinally long hole 20 substantially at the center thereof, a rectangular opening 21 in the slightly lower portion and a notch 22 at the center of the lower end portion, and a recess 23 is formed on the notch 22 of one of side plates 14.

Each metal cover plate 15 has a plurality of slits 24 aligned in parallel to each other.

A shaft 25 has a screw hole 26 at each end thereof. When screws 28 are passed through washers 27 and the longitudinally long holes 20 of the respective side plates 14 and screwed into the screw holes 26, the shaft 25 is attached to the side plates 14.

A plurality of rotary members 29 are rotatably supported on the shaft 25. Each rotary member 29 comprises a holding member 30 and a hanging cylinder 31.

Each holding member 30 is composed of a synthetic resin and comprises an annular plate 33 having non-skid teeth 32 on the peripheral edge thereof and a cylinder 35 formed integrally with one side face of said annular plate 33, said cylinder 35 having a key groove 34 extending in the axial direction on the peripheral face of the cylinder 35.

Each hanging cylinder 31 is composed of a synthetic resin and has on the inner peripheral face thereof a key 36 to be engaged with said key groove 34. On the outer peripheral face of the hanging cylinder 31, a great number of ridges 37 having a cone-shaped section are formed integrally with the cylinder 31 to extend in the axial direction thereof so that they are spaced from each other in the peripheral direction. Two each of ridges 37 are paired.

These pairs of the ridges 37 are divided into the front and rear groups with respect to the axial direction of the hanging cylinder 31, and these ridges 37 are so arranged that the positional phases in the peripheral direction of the ridges 37*a* of the front group and the ridges 37*b* of the rear group are different from each other. In short, pairs of the ridges 37 are disposed in a zigzag manner.

A bridge member 38 is laid between the notches 22 of the side plates 14 of the frame body 10. This bridge member 38 comprises a bridge girder 39, an ink absorber-containing casing 40 and a bottom lid 41.

The bridge girder 39 is made of a metal plate and comprises a long plate 42, downwardly bent portions 43 extended from respective ends of the plate 42, outwardly bent portions 44 extended from respective downwardly bent portions 43 and upwardly bent portions 45 extended from respective outwardly bent portions 44. An opening 46 is formed on one of the downwardly bent portions 43.

The casing 40 for containing an ink absorber therein is composed of a synthetic resin and comprises a top face wall 47, downwardly extending two side walls 48 and downwardly extending two end walls 49. The casing 40 has a downwardly facing opening 50 in the lower end portion thereof and an ink feeding short cylinder 51 on one end wall 49. A screw hole 52 is perforated on the short cylinder 51.

The bottom lid 41 is made of a metal plate and comprises a long plate 54 having a long opening 53 and upwardly extending side walls 55.

The bridge girder 39 is disposed so that the outwardly bent portions 44 are placed on the notches 22 of the corresponding side plates 14 of the frame body 10, respectively, and the casing 40 is disposed so that the short cylinder 51 is passed through the opening 46 of the bridge girder 39 and the recess 23 of the side plate 14 of the frame body 10 and is located between the downwardly bent portions 43 of the bridge girder 39. In this state, if the screw 56 is screwed into the screw hole 52, the casing 40 is fastened.

An ink absorber 57 is a square column composed of a porous material, in which ink is to be absorbed and stored. The ink absorber 57 is contained in the casing 40.

The bottom lid 41 is disposed so that the two upwardly extending side walls 55 thereof cover the casing 40, and the lower face of the ink absorber 57 projects slightly from the long opening 53 of the bottom lid 41.

A printing body 58 comprises a plurality of sections of an endless belt form, each of which is composed of a porous rubber or synthetic resin having an very large number of interconnecting cells and has on the surface thereof a great number of printing letter portions 59.

Each section of the printing body 58 is hung around the corresponding hanging cylinder 31 and bottom lid 41, and the back face of each section of the printing body 58 is contacted with the lower face of the ink absorber 57, whereby ink is always fed to the printing body 58 from the ink absorber 57 and absorbed in the printing body 58.

When the quantity of ink impregnated in the ink absorber 57 is reduced, the screw 56 is dismounted and fresh ink is injected into the casing 40 through the screw hole 52, whereby fresh ink is absorbed and stored in the ink absorber 57.

A thin partition plate 60 composed of a synthetic resin is disposed between the annular plate 33 of the rotary member 29 and the section of the printing body 58 hung on the hanging cylinder 31, to prevent ink absorbed in said printing body section 18 from being applied to the annular plate 33.

A leg frame 61 composed of a metal plate comprises a long plate 63 having a long opening 62 and walls 62 and 65 extending upwardly from the sides and ends of said long plates 63. Each of the end walls 65 has a guiding hole 66 and an inwardly extending flange 67 on the top end thereof.

Spring means 68 comprises a pair of spring members, each of each includes a spring supporting member 69 and a spring plate 70 supported thereon.

The spring supporting member 69 is composed of a synthetic resin and comprises a head portion 71, a projection 73 extended from the central portion of the side face of the head portion 71 and having a recess 72 on the lower face thereof, and a pair of leg portions 75 connected to the free end 74 of the projection 73 and extended toward the head portion 71 on both the sides of the projection 73. A recess 76 is formed on the upper face of the projection 73 between the two leg portions 75 and engaging projections 78 are formed outside the free end portions 77 of the leg portions 75, whereby a space 79 is formed between the projection 73 and the free ends 77 of the leg portions 75 and the two leg portions 75 can be bent.

The spring plate 70 is made of a metal plate and has a U-figured shaped including enlarged terminal portions 80 and an intermediate narrow portion 81. One enlarged terminal portion 80 is placed between the two leg portions 75 on the top face of the spring supporting member 69, the narrow portion 81 is placed on the recess 76 and the other enlarged terminal portion 80 is disposed so that it can come in and out the recess 72.

Respective upwardly extending walls 64 and 65 of the leg frame 61 are disposed to surround the outside of all the side plates 14 of the frame body 10, and respective upwardly bent portions 45 of the bridge girder 39 are disposed in the corresponding guiding holes 66 of the leg frame 61. When the leg portion 75 of each spring supporting member 69 is inserted in the rectangular opening of the corresponding side plate 14 of the frame body 10 and the spring 78 of the leg portion 75 is engaged with the side plate 14, the inwardly extending flange 67 of each leg portion 61 is pressed by the lower enlarged portion 80 of the spring plate 70.

In a modification illustrated in FIG. 6, respective ridges 37*a* and 37*b* are disposed independently and separately while not forming pairs of ridges.

In another modification shown in FIG. 7, a rotary member 129 comprises a handling member 130 and a hanging cylinder 131, which are molded integrally with each other.

Figure 8:
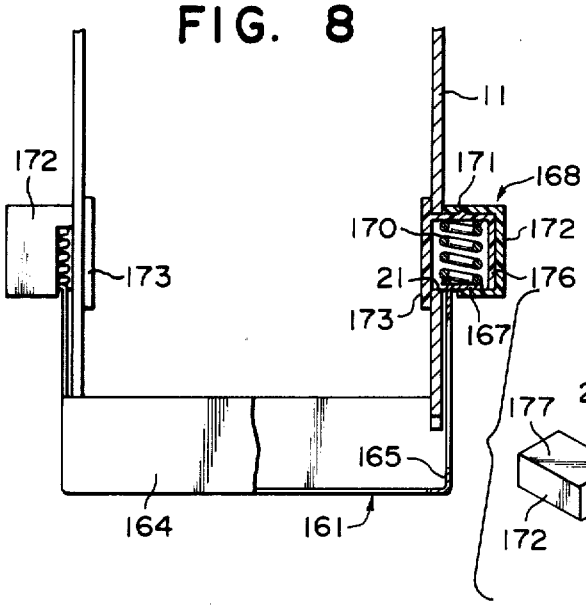
FIG. 8 is a partially longitudinally sectional front view illustrating one modification of the spring means and leg frame in the embodiment shown in FIG. 1.
Figure 9:
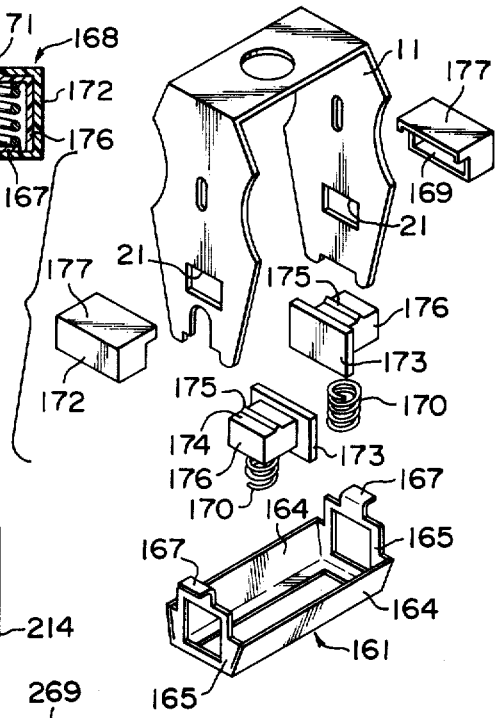
FIG. 9 is a fragmentary perspective view of the modification shown in FIG. 8.

In still another modification illustrated in in FIGS. 8 and 9, a leg frame 161 has outwardly extending flanges 167 on the top ends of walls 165 upwardly extending from both the ends of the leg frame 161. Each spring means 168 includes a casing 172 having a laterally facing opening 169 and a groove 171 formed on the inner face of a top wall 177, a box-like leg portion 176 having a flange 173 on one side, a projection 175 on the top face of a top wall 174, said projection being capable of being engaged with said groove 171 and said box-like leg portion 176 being fitted in the casing 172, and a coil spring 170 contained in the box-like leg portion 176.

The upwardly extending walls 164 and 165 of the leg frame 161 are disposed outside the respective side plates 14 of the frame body 10, and the box-like leg portion 176 is inserted into the rectangular opening 21 from the inside of the side plate 14. The coil spring 170 is disposed between the flange 167 of the leg frame 161 and the inner face of the top wall 174 of the box-like leg portion 176, and the outside of the box-like leg portion 176 and the flange 167 are covered with the casing 172 and the projection 175 is engaged with the groove 171.

Figure 10:
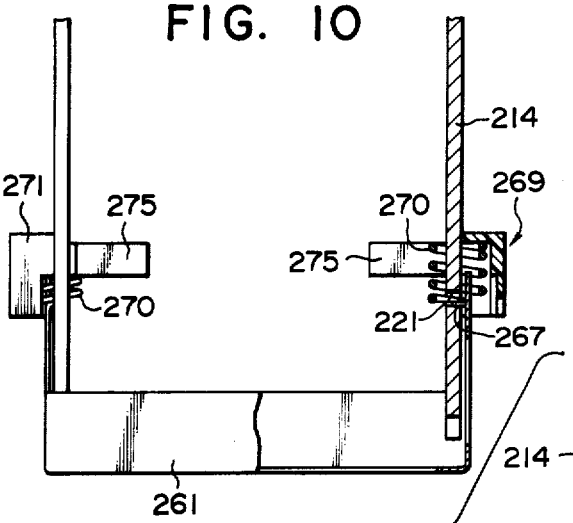
FIG. 10 is a partially longitudinally sectional front view illustrating another modification of the frame body, spring means and leg frame in the embodiment shown in FIG. 1.
Figure 11:
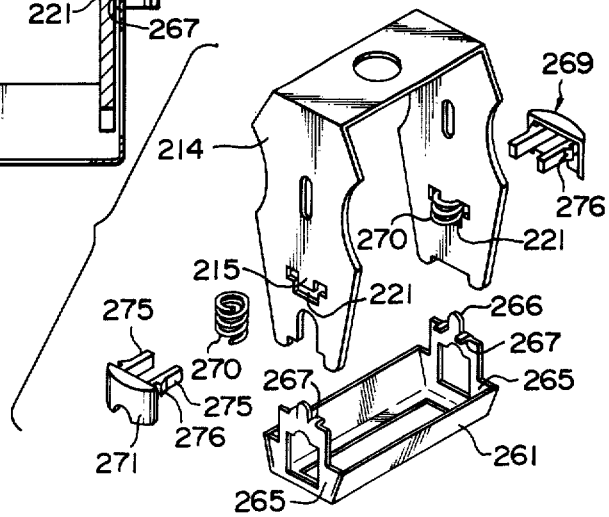
FIG. 11 is a fragmentary perspective view of the modification shown in FIG. 10.

In still another modification shown in FIGS. 10 and 11, an opening 221 perforated in the lower portion of each side plate 214 of the frame body 10 has a substantially U-figured shape and a projection 215 is disposed to project downwardly from the side plate 214 into the opening 221.

A leg frame 261 has upwardly extending projections 266 on the central portions of the top ends of respective walls 265 extending upwardly from the end portions of the leg frame 261 and each wall 265 has an inwardly extending flange 267 on one side thereof.

A spring supporting member 269 comprises a head portion 271 and a pair of leg portions 275 projecting from one side thereof, and each leg portion 275 has a projecting spring 276 on the outer side face thereof.

The leg frame 261 is disposed outside the respective side plates 214 of the frame body 10, and the leg portion 275 of the spring supporting member 269 is inserted into the opening 221 from the outside. The projection 215 is surrounded by the coil spring 270 and disposed between both the leg portions 275. The flange 267 of the leg frame 261 is disposed between the lower end of the opening 221 and the coil spring 270, and the projecting spring 276 is engaged with each side plate 214.

Figure 12:
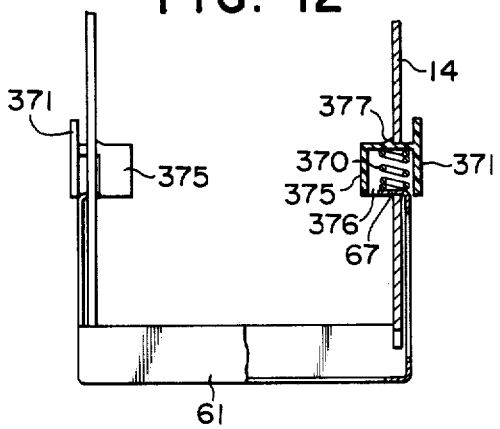
FIG. 12 is a partially longitudinally sectional front view of still another modification of the spring means and leg frame in the embodiment shown in FIG. 1.
Figure 13:
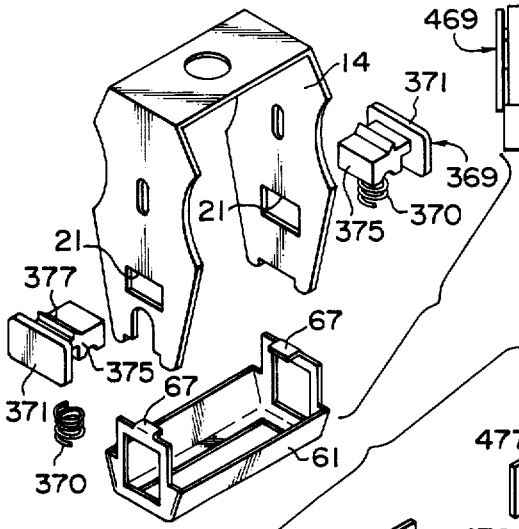
FIG. 13 is a fragmentary perspective view of the modification shown in FIG. 12.

In a modification shown in FIGS. 12 and 13, a spring supporting member 369 comprises a head portion 371 and box-like leg portion 375 extended from one side of the head portion 371 and having a downwardly facing opening 376. A projecting spring 377 is mounted on the top face of the box-like leg portion 375.

Respective box-like leg portions 375 are inserted into openings 21 of corresponding side plates 14 from the outside, and a coil spring 370 is contained in the box-like leg portions 375. The flange 67 of the leg frame 61 is disposed between the lower end of the opening 21 and the coil spring 370, and the projecting spring 377 is engaged with the side plate 14.

Figure 14:
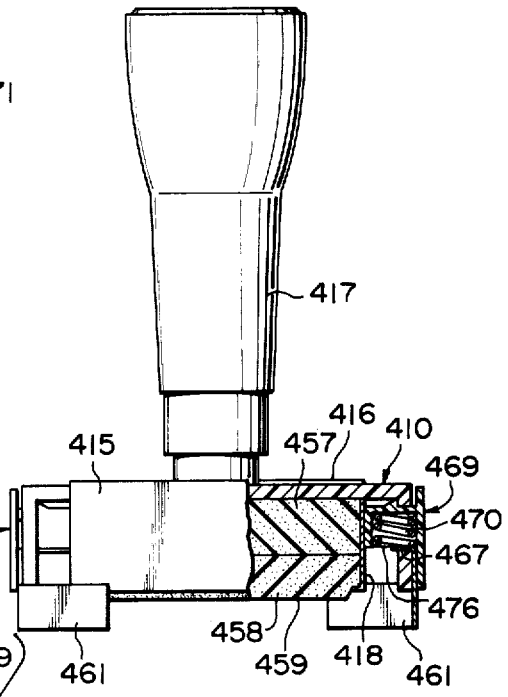
FIG. 14 is a partially longitudinally sectional front view of another embodiment of the hand stamp of this invention.
Figure 15:
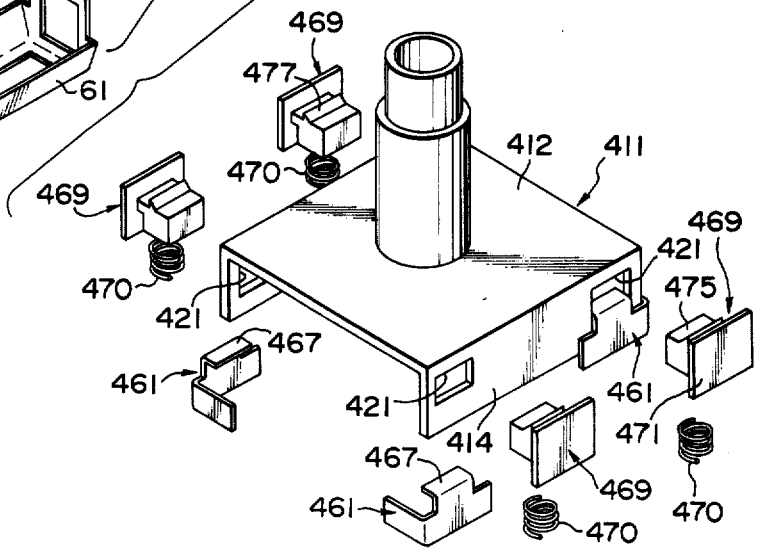
FIG. 15 is a fragmentary perspective view of the embodiment shown in FIG. 14.

In a further modification shown in FIGS. 14 and 15, a frame body 410 comprises a substantially reverse U-figured member 411 including a top plate 412 and side plates 414 extended from both the ends of the top plate 412, and a cover plate 415 having a laterally extending flange 416 at the upper end and a supporting frame 418 for the ink absorber and printing body at the lower end. The frame body 410 is attached to a handle 417. Each side plate 414 has two rectangular openings 421.

A leg frame 461 comprises four L-figured members, each of which has an inwardly extending flange 467 at the top end. A spring supporting member 469 comprises a head portion 471 and a box-like leg portion 475 mounted on one side of said head portion 471, and the box-like leg portion 475 has a downwardly facing opening 476 and a projecting spring 477 on the top face thereof.

A coil spring 470 is contained in the box-like leg portion 475, and the box-like leg portion 475 is inserted into the rectangular hole 421 from the outside of the side plate 414, and the leg frame 461 is disposed outside each side plate 414. The flange 467 of the leg frame 461 is disposed between the coil spring 470 and the lower end of the opening 421, and the projecting spring 474 is engaged with the side plate 414.

An ink absorber 457 and a printing body 458 piled thereon are supported by the supporting member 418, and a printing letter portion 459 of the printing body 458 is disposed to project slightly from the lower end of the side plate 414 of the frame body 410.

In the hand stamp of this invention having the foregoing structure, since the leg frame is disposed outside the frame body to surround the frame body, it has a larger contour size than the leg frame of the conventional hand stamp when compared based on the same prescribed size of the printing letter portion. Accordingly, the hand stamp of this invention has a better stability when placed erectly on a desk or the like. Further, when the hand stamp of this invention is assembled, since the leg frame can be constructed after assembling of respective members in the frame body, the assembling operation can be greatly facilitated and adjustment of the respective members after assembling can be easily performed.

Further, in the hand stamp of this invention, since ridges formed on the hanging cylinder are divided into the front and rear groups with respect to the longitudinal directions, and these ridges are so arranged that the positional phases in the peripheral direction of the front and rear groups of the ridges are different from each other, a printing body of an endless belt form is engaged with these two groups or rows of ridges differing in the positional phase in the peripheral direction and hence, even if the peripheral distance between the two rows of the ridges is relatively large, the engaging angle of the printing body of an endless belt form with the two rows of the ridges can be reduced. Therefore, the rotation force of the hanging cylinder can be transmitted to the printing body of an endless belt form very assuredly and a force required for the rotation of the hanging cylinder can be reduced.

What is claimed is:

1. A hand stamp comprising a frame body having a substantially reverse U-figured shape and including a top plate and side plates connected to edges of said top plate, each of said side plates having a lower opening at a lower portion thereof; a shaft attached to a substantially central portion of said side plates; a plurality of rotary members rotatably supported on said shaft, each rotary member comprising an annular plate having nonskid teeth on a peripheral edge thereof and a hanging cylinder formed on one side face of said annular plate, a plurality of ridges having a triangular cross-section being formed on a circumferential surface of said hanging cylinder to extend parallel to an axial direction thereof so that they are spaced from one another in the peripheral direction of said hanging cylinder; said ridges being divided into two front and rear groups with respect to the axial direction of said hanging cylinder, the ridges of said front group being staggered with respect to the ridges of said rear group; a bridge member on a lower end of said frame body; an ink absorber supported in said bridge member; printing bodies comprising a plurality of sections in the form of an endless belt, each section of said printing bodies being hung around the corresponding hanging cylinder of the rotary member and a lower face of the ink absorber supported in said bridge member and being composed of a porous material having a relatively large number of open cells, said printing bodies including printing letter portions projecting from the lower portion of said frame body when the printing letter portions occupy their lowest position with respect to said ink absorber; a leg frame comprising a long plate having a long hole, upwardly extending side walls, upwardly extending end walls having guiding openings and a lateral flange disposed on a top end of each of said upwardly extending end walls, said leg frame being mounted to be movable in an upward and a downward directon from the lowest position of said printing letter portions, said long hole of said leg frame allowing said printing letter portions to pass therethrough, said upwardly extending end and side walls of said leg frame being disposed so as to surround the outside of the respective side plates of said frame body, said bridge member comprising a bridge girder including upwardly bent portions, said upwardly bent portions being disposed in the guiding openings of the corresponding end walls of the leg frame; and spring means for pushing said leg frame to project from the lowest position of said printing letter portions, said spring means comprising a pair of spring members, each spring member including a supporting member having a leg portion and a spring supported on said leg portion, the respective leg portions of said spring means being engaged with the lower openings of the corresponding side plates of said frame body, said lateral flanges on the upwardly extending end walls of said leg frame being disposed so that they are pressed by the corresponding springs of said spring means.

2. A stamp as set forth in claim 1, wherein each side plate of the frame body has a vertical long hole substantially at the center thereof, an opening slightly below said long hole and a notch at the center of its lower end, and one of the side plates having a recess at the center of said notch; said shaft being attached to said side plates of said frame body at said long holes; said bridge girder including a long plate, downwardly bent portions extending from respective ends of said long plate, outwardly bent portions extending from said downwardly bent portions and upwardly bent portions extending from said outwardly bent portions, an opening being formed in one of said downwardly bent portions, an ink absorber-containing casing including a top face wall, two downwardly extending end walls and a downwardly facing opening in the lower portion thereof, a cylinder for feeding ink being mounted on one of said end walls, and a bottom lid including a long plate having a long open hole and two upwardly extending side walls; said bridge girder being disposed so that respective outwardly bent portions thereof are placed on the notches of the corresponding side plates of said frame body; said casing being disposed between said downwardly bent portions of said bridge girder so that the cylinder thereof is located through the opening of said bridge girder and the recess of the side plate of said frame body; said ink absorber being disposed in said casing; said bottom lid being disposed so that said casing is covered with the two upwardly extending side walls thereof and the lower face of said ink absorber projects from said long open hole of said bottom lid; each of said sections of said printing bodies extending around said bottom lid.

* * * * *